United States Patent [19]

Tholen et al.

[11] 4,377,989

[45] Mar. 29, 1983

[54] AIR-COOLED INTERNAL COMBUSTION ENGINE HAVING A COOLING AIR BLOWER DRIVEN BY A HYDRAULIC COUPLING

[75] Inventors: Paul Tholen, Bergisch Gladbach; Achim zur Nieden; Peter Sost, both of Cologne, all of Fed. Rep. of Germany

[73] Assignee: Klöckner-Humboldt-Deutz Aktiengesellschaft, Cologne, Fed. Rep. of Germany

[21] Appl. No.: 330,908

[22] Filed: Dec. 15, 1981

[30] Foreign Application Priority Data

Dec. 18, 1980 [DE] Fed. Rep. of Germany ..... 3047781

[51] Int. Cl.[3] ..... F01P 5/04

[52] U.S. Cl. ..... 123/41.65; 60/329; 123/41.12; 123/41.49

[58] Field of Search ..... 123/41.11, 41.12, 41.49, 123/41.65, 41.66; 464/24; 165/121; 60/329, 396

[56] References Cited

U.S. PATENT DOCUMENTS

| | | | |
|---|---|---|---|
| 3,483,852 | 12/1969 | Newman et al. | 123/41.12 |
| 3,710,765 | 1/1973 | Dorsch | 123/41.12 |
| 4,062,329 | 12/1977 | Rio | 123/41.49 |
| 4,066,047 | 1/1978 | Vidakovic et al. | 123/41.49 |
| 4,223,646 | 9/1980 | Kinder | 123/41.49 |

FOREIGN PATENT DOCUMENTS

| | | | |
|---|---|---|---|
| 1170194 | 5/1964 | Fed. Rep. of Germany | 123/41.12 |

*Primary Examiner*—William A. Cuchlinski, Jr.
*Attorney, Agent, or Firm*—Becker & Becker, Inc.

[57] ABSTRACT

An air-cooled internal combustion engine having a cooling air blower which is driven by a hydrodynamic coupling from the internal combustion engine. The hydrodynamic coupling is thermostatically regulated or controlled by oil flow supplied thereto, as a result of a filling thereof as a function of the temperature of a structural port, or of the exhaust gas, or of the heated cooling air. In order to adapt to the atmospheric air pressure, the oil filling of the hydraulic coupling is additionally supplied with oil via an additional filling line controlled by a barometric diaphragm and a regulator, with the hydrodynamic coupling being dimensioned larger for receiving this additional filling quantity.

9 Claims, 5 Drawing Figures

AIR-COOLED INTERNAL COMBUSTION ENGINE HAVING A COOLING AIR BLOWER DRIVEN BY A HYDRAULIC COUPLING

The present invention relates to an air-cooled internal combustion engine having a cooling air blower which is driven by a hydrodynamic coupling from the internal combustion engine. The hydrodynamic coupling is thermostatically controlled or regulated by oil flow supplied thereto, as a result of a filling thereof as a function of the temperature of a structural part, or of the exhaust gas, or of the heated cooling air.

With internal combustion engines which are used at higher elevations, the capacity of the cooling blower decreases along with a decrease of the air density, so that the cooling capacity of the cooling system, which as a rule is designed to operate at just above sea level, is not sufficient.

When operating at high elevations, although a reduction of mechanical power (output) accompanies a lower cooling capacity of the blower, with engines having superchargers this is negligibly small, so that there a definite decrease of the necessary cooling capacity occurs.

The speed of the cooling blower must be increased to compensate for the smaller capacity at lower air densities. This speed increase, for instance during operation at 2260 meters elevation, must be approximately 25% greater than for an engine operated at sea level, with approximately 0.8 times the air pressure compared with that at sea level. This corresponds to a linear growth of the capacity of the blower from 100% to 125%. The speed increase of the cooling blower to 125%, however, simultaneously means a power input of the cooling blower to a power of three, which corresponds to a power increase to 196% of the original power. If the cooling blower were designed for this increased power, and were then operated at sea level, at maximum blower speed there would always result a power loss of 96% of the original 100% blower power. The power is 157% during operation at an elevation of 2260 meters at 0.8 times normal pressure. These relationships or conditions are illustrated by the curves a and b of the graph of FIG. 1, and will be described in greater detail subsequently.

According to German Pat. No. 755 203, it is known to determine the air pressure in the charging air line of an internal combustion engine by means of a barometric diaphragm, and as a function thereof to control or regulate a charging air blower which is driven by the internal combustion engine via a hydraulic coupling. Disadvantageous herewith is that for the blower drive, two hydraulic couplings are provided, and for the oil supply thereof, two separate oil pumps are provided. A further oil pump with a drive must be provided for the lubricating oil supply of the internal combustion engine. Such a structural cost for the additional oil flow, to attain a higher blower speed, is disproportionately large and costly.

It is an object of the present invention, with an air-cooled internal combustion engine having a cooling air blower, the power of which is designed for operating conditions at greater elevations to constantly adapt to the lower cooling air requirement during operation at lower elevations, as for instance at sea level, so that the least possible power loss of the cooling blower results.

This object, and other objects and advantages of the present invention, will appear more clearly from the following specification in connection with the accompanying drawings, in which.

Figure 4:
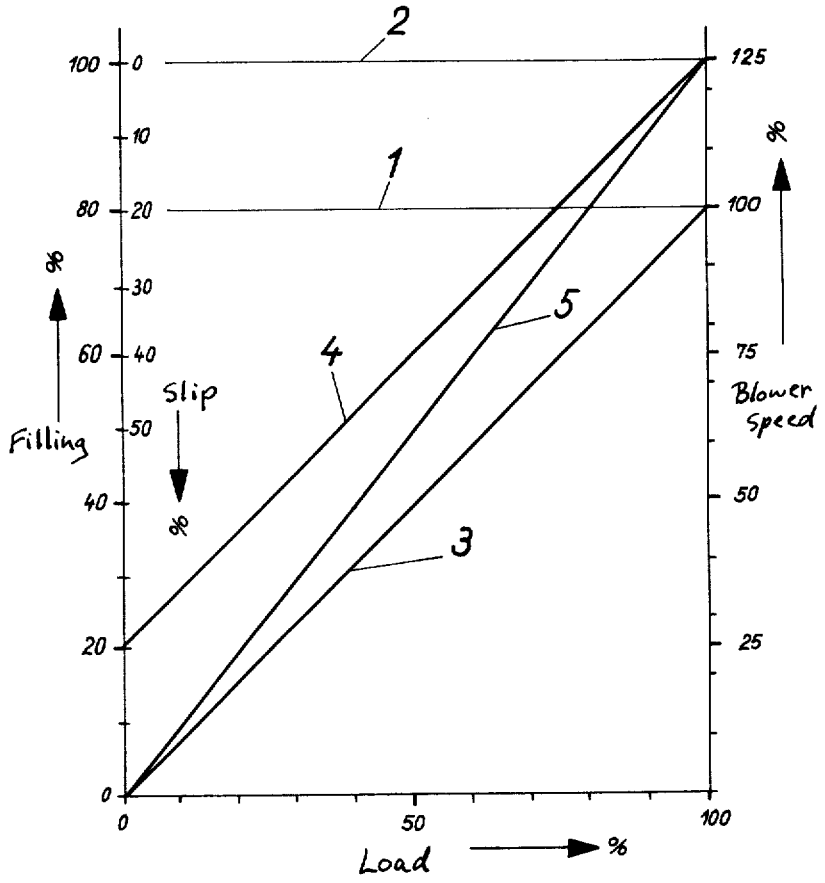
Figure 5:
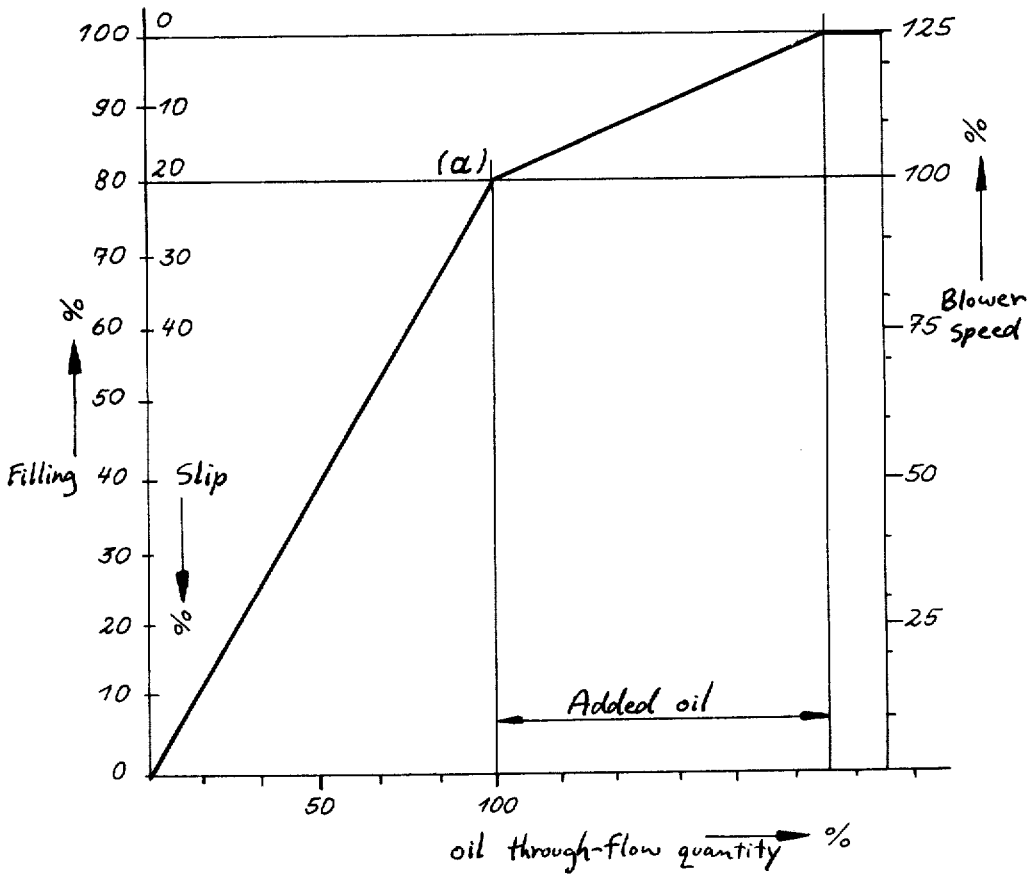

FIG. 4 is a graph showing the dependence of the cooling blower speed or filling of the hydraulic coupling on the power, and hence on the cooling air requirement, of the internal combustion engine; and FIG. 5 is a graph showing the dependence of the cooling blower speed on the oil through-flow quantity of the hydraulic coupling, whereby the hydraulic coupling experiences a change of the filling characteristic as the result of an overflow.

The hydrodynamic coupling of the present invention is characterized primarily in that, in order to adapt to the atmospheric air pressure, the oil filling of the hydraulic coupling is supplied additionally with oil by means of a regulator and a barometric diaphragm via an additional filling line, with the dimensions of the hydrodynamic coupling being greater for receiving this additional filling quantity.

With the aid of such a cooling air blower, it is possible to adapt the cooling air requirement to the actual air density. This occurs with a cooling air blower which is designed for an increased demand of 25% cooling air at lower air density, by throttling the additional oil quantity when at sea level the engine is set at 100% delivery power or efficiency instead of 125%. For this purpose, the oil is branched off from the lubricating oil supply of the internal combustion engine as an operating medium of the hydraulic coupling; the oil is regulated in two parallel oil flows independently of each other, and is supplied in common to the hydraulic coupling.

One of the partial flows is regulated as a function of the exhaust gas temperature of the internal combustion engine, with the quantity thereof being approximately $\frac{3}{4}$ of the branched-off oil quantity. This meets the entire cooling air quantity requirement when the engine is operated at sea level.

For the additionally required cooling air quantity when the air density is reduced, it is proposed that the other partial flow be regulated as a function of the atmospheric air pressure, with this partial flow delivering $\frac{1}{4}$ of the branched-off oil quantity.

In order to dose the $\frac{3}{4}$ partial flow of the branched-off oil quantity with simple means, it is proposed that the through-flow cross sections for this partial flow be such that they permit passage of only $\frac{3}{4}$ of the branched-off oil quantity.

A further assurance of the cooling capacity limitation is attained by providing an oil discharge opening in the inner housing of the hydrodynamic coupling. This opening is arranged at such a distance from the middle of the hydraulic coupling that only an oil ring of 80% filling can accumulate in the coupling, but upon opening the connection of the second partial flow, which is barometrically regulated, the further filling of the coupling occurs to 100%, which corresponds to 125% blower speed.

In order to stabilize the control or regulation at low adjustment forces of the measured-value emitter, it is proposed that the regulation of the partial flows be effected by servo devices.

Figure 1:
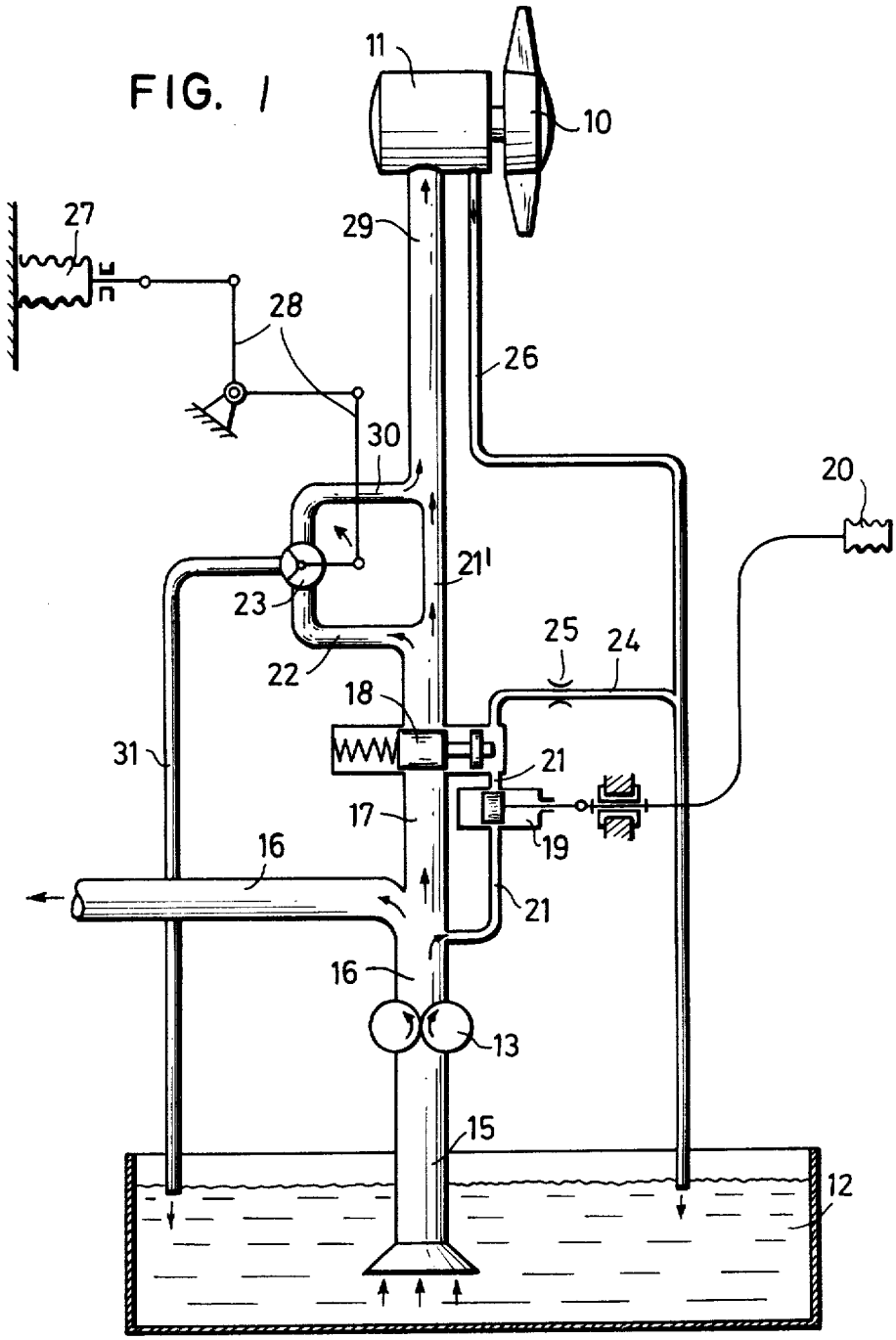
FIG. 1 shows one inventive embodiment of the drive and control devices of a cooling air blower with an operating medium circulation.

Referring now to the drawings in detail, FIG. 1 illustrates the cooling air blower 10 of an internal combustion engine, which is not illustrated in greater detail. The blower 10 is operated by a hydraulic coupling 11 which is supplied with oil from the pressure or forced-feed lubrication 12,15; 13,16 of the internal combustion engine, and is controlled by two control or regulating devices. To supply the forced-feed lubrication of the internal combustion engine, lubricating oil is drawn out of the oil pan 12 through a suction line 15 by the oil pump 13, and is supplied to the points of lubrication via the pressure line 16. A pressure line 17 branches off from the pressure line 16, and supplies pressurized oil to the volume regulator 18. The regulator 18 (shown in the closed position) is controlled by the control piston 19 via an exhaust gas thermostat 20 in such a way that when the exhaust gas temperature increases, pressurized oil acts upon the piston 18 through the line 21; the pressurized oil shifts this piston 18 axially until the conduit 17 is opened to allow oil to flow through to the hydraulic coupling 11 via the line 21' and the bypass line 22 to the regulating device 23. The line 24, which is provided with a flow control device 25, serves for pressure relief during displacement of the control piston 19 in the opposite direction.

The line 21' is so dimensioned that it permits passage of only that oil quantity or volume which fills the hydraulic coupling 11 to 80%. To prevent overfilling, an overflow opening 40 is provided in the hydraulic coupling 11 (FIG. 2), with excess oil returning to the oil pan 12 via the line 26.

The bypass line 22 is controlled by a rotary slide valve of the regulating device 23, and this slide valve is controlled by the barometric diaphragm 27 via a linkage 28. When the barometric pressure decreases, the slide valve is rotated into the open position, so that an additional quantity of oil can flow through the line 29 to the hydraulic coupling 11, thereby filling the coupling to 100%. When the barometric pressure rises, the bypass conduit 30 is closed, so that the oil can flow back to the oil pan 12 via the line 31.

Figure 2:
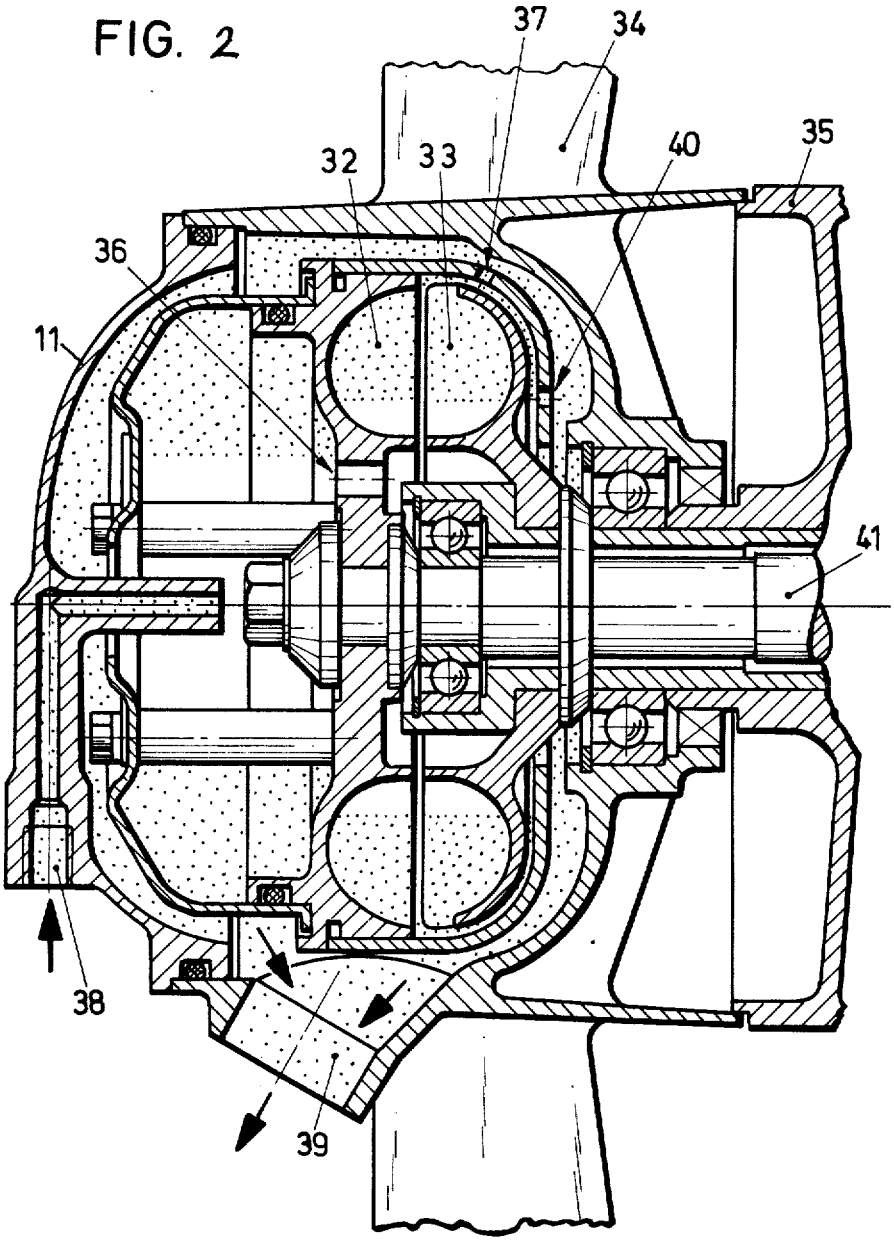
FIG. 2 is a longitudinal cross section through a hydraulic coupling.

FIG. 2 is a longitudinal cross section through the hydraulic coupling 11, which forms a structural unit with the cooling air blower 10. The hydraulic coupling 11 forms the hub of the cooling air blower 10, and is connected with the outer blower housing by means of the guide vanes 34. The drive shaft 41, which is connected with the primary impeller 32, transfers the torque with more or less strong slip (depending upon the filling of the coupling) onto the secondary impeller 33, which is connected with the blower rotor 35. The filling of the coupling 11 with lubricating oil determines the slip, and hence the blower speed. The oil supply to the hydraulic coupling is effected via a tapped hole connection 38, and channels from the center of the coupling via openings 36; the oil return, on the other hand, is effected from the periphery of the oil ring formed in the coupling, via the socket connection 39 in the outer housing. The opening 40, which permits small excess quantities to pass to the lubrication, serves to limit an oil ring, which corresponds to approximately 80% of the coupling filling, in the coupling by means of an overflow. During oil supply through the bypass 22, 30 (FIG. 1), such a large oil quantity is obtained that it can no longer flow off via the opening 40. The coupling 11 then fills up to 100%. The oil now flows off in a known manner in the peripheral direction to the socket connection 39 through the bore 37, the overflow opening 40, and the housing inner diameter opening.

Figure 3:
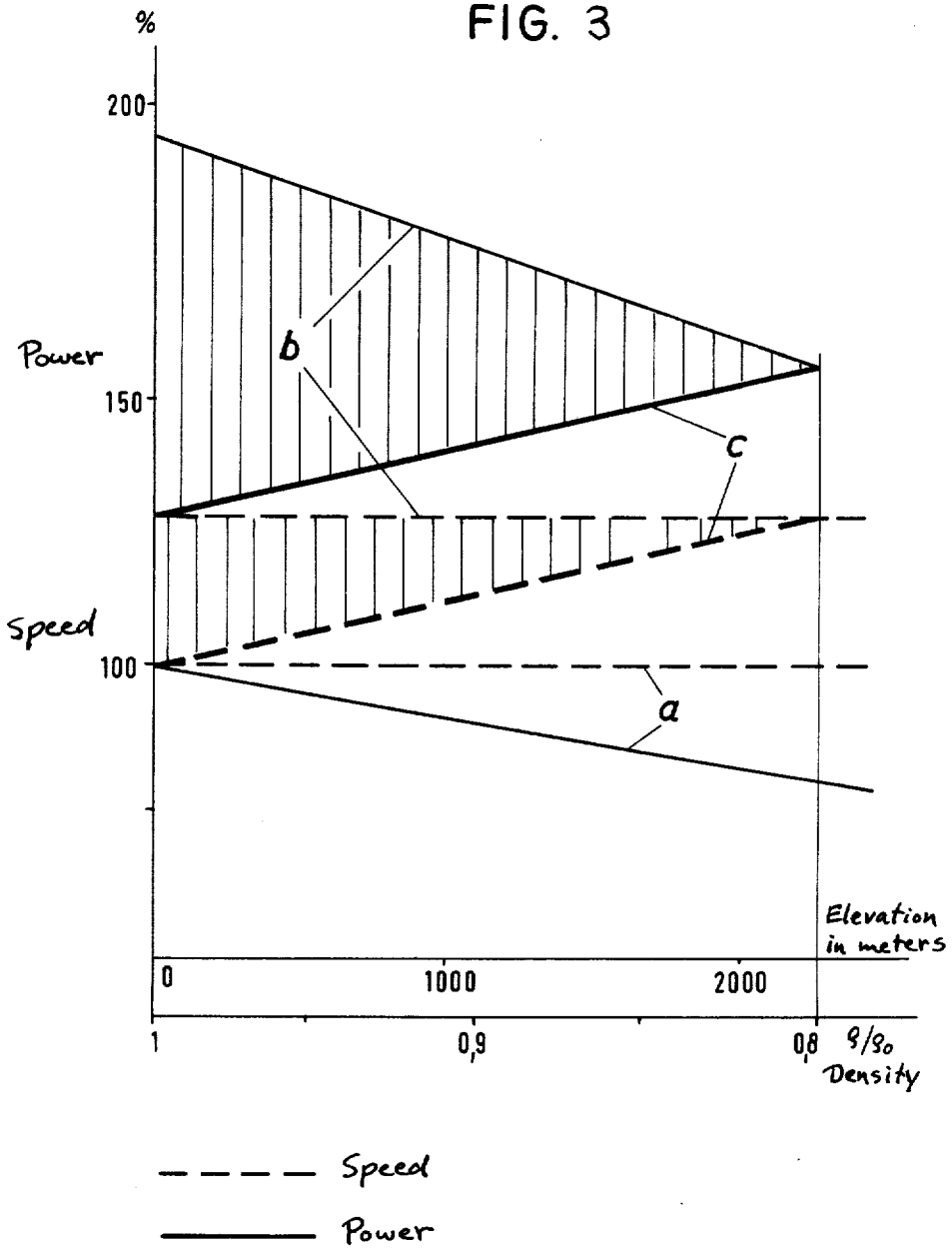
FIG. 3 is a graph showing the power or speed of a cooling blower plotted as a function of the air density or the elevation above sea level.

In the graph of FIG. 3, the air density and the local elevation above sea level are plotted on the abscissa, and the power and the speed of a cooling blower are plotted on the ordinate, and in particular for three different situations. The solid line represents the power, and the dash line represents the speed of the cooling blower. In situation (a), a constant blower speed of 100%, corresponding to the full cooling capacity, is assumed, with the power decreasing continuously as the elevation above sea level increases, because the air density $\rho:\rho_O$ likewise decreases. At an elevation of 2260 m, an air density of approximately 0.8 exists, compared with the air density of 1.0 at sea level.

In the situation (b), the graph shows a cooling air blower having a power of 196% as a result of increasing the speed to 125% at sea level; however, at an elevation of 2260 meters, the blower only has a power of $0.8\times196=157\%$. The cooling capacity thus produced, however, is sufficient to compensate for the cooling capacity, which decreases with decreasing air density.

The obvious drawbach of such a cooling system, which was originally designed for higher elevations, is that when used at sea level it constantly consumes 96% more power, and consequently operates very uneconomically.

Situation (c) shows how the unfavorable conditions of situation (b) can be avoided. Although the blower is designed for 125% over speed, as a result of controlled or regulated slip, it operates at sea level with only 100% speed; a necessary speed increase is attained by reducing the slip by means of an increased filling, which is controlled as a function of air pressure. In this connection, the power increases continuously to 156%, and the speed to 125%; this corresponds to a constant air volume throughput.

The vertically crosshatched surfaces represent the attainable gain at the respective elevations for the blower (c) relative to the blower (b) with respect to power and speed. The shading between the dash speed lines shows the gain in speed; in the same manner, the shading between the solid power lines represents the gain in power.

In the graph of FIG. 4, the mechanical power (output) is plotted on the abscissa, and the cooling blower speed and the accompanying filling of the hydraulic coupling, with its slip, are plotted on the ordinate.

In a manner analogous to the illustration in FIG. 3, three situations are also illustrated in FIG. 4. In situation 1, line 3, at the intersection with line 1, shows the condition of 100% blower speed and filling. Since this filling and speed are not sufficient for operation at higher elevations, a filling and speed increase to 125% is again assumed, which is illustrated by the line 4, which extends to the speed line 2. A prerequisite is naturally a correspondingly larger hydraulic coupling. With the inventive control or regulation as a function of barometric pressure in connection with the existing power control of the engine, there results a filling of a hydraulic coupling corresponding to line 5.

The graph of FIG. 5 illustrates the effect of the overflow bore 40 (FIG. 5) provided in the inner housing of the hydraulic coupling; this bore 40 is intended for limiting the filling to 80%. The oil through-flow volume is plotted on the abscissa, and the blower speed and the filling of the hydraulic coupling are plotted on the ordinate. According to the plotted curve, after a linear rise this curve reaches the 80% filling at point (a), with simultaneous 100% of speed. A balance or equilibrium prevails at this operating level, without additional filling. If however, the additional oil quantity is released as a result of the barometric control, then the curve rises at a lesser slope to 100% filling and 125% speed.

The present invention is, of course, in no way restricted to the specific disclosure of the specification and drawings, but also encompass any modifications within the scope of the appended claims.

What we claim is:

1. In combination with an air-cooled internal combustion engine having a cooling air blower and a supply of lubricating oil; a hydrodynamic coupling operatively drivingly connected to said cooling air blower, and itself being driven by a portion of said oil as operating medium with the filling of said coupling with said oil being thermostatically regulated; the improvement comprising further adapting the filling of said coupling with oil to the atmospheric air pressure, and includes a coupling oil-supply line, which communicates said portion of said supply of lubricating oil to said coupling; a bypass additional filling line connected to said coupling oil-supply line to effect supplying additional oil to said coupling in response to a decrease in atmospheric air pressure; a regulator arranged in said bypass additional filling line for regulating flow of oil therethrough as a result of its position therein; and a barometric diaphragm operatively connected to said regulator for controlling the position thereof in said bypass additional filling line, said coupling being appropriately dimensioned to accommodate said additional oil.

2. A hydrodynamic coupling according to claim 1, in which said thermostatic regulation of said filling of said coupling with oil is effected as a function of the temperature of one of a structural part, the exhaust gas, and the heated cooling air.

3. A hydrodynamic coupling according to claim 1, which includes a main pressure line loading from said supply of lubricating oil to said internal combustion engine, and in which said coupling oil-supply line is a branch line from said main pressure line.

4. A hydrodynamic coupling according to claim 3, in which said branch line forms a first line and is provided with said bypass additional filling line, said first line and said bypass line being independently regulated and coming together into a common line which leads to said coupling.

5. A hydrodynamic coupling according to claim 4, in which said first line is regulated as a function of the exhaust gas temperature of said internal combustion engine, and handles approximately $\frac{3}{4}$ of the maximum oil in said branch line.

6. A hydrodynamic coupling according to claim 5, in which said bypass line, which is regulated as a function of the atmospheric pressure, handling approximately $\frac{1}{4}$ of the maximum oil in said branch line.

7. A hydrodynamic coupling according to claim 5, in which the flow-through cross sections of said first line are dimensioned in such a way as to permit passage of only $\frac{3}{4}$ of the maximum oil in said branch line.

8. A hydrodynamic coupling according to claim 7, in which said coupling is provided with an inner housing which in turn is provided with an oil overflow opening for regulating the filling of said coupling.

9. A hydrodynamic coupling according to claim 8, which includes servo devices for regulating the flow of oil through said first line and said bypass line.

* * * * *